US008364379B2

(12) United States Patent
Johnson et al.

(10) Patent No.: US 8,364,379 B2
(45) Date of Patent: Jan. 29, 2013

(54) CONTROL SYSTEM AND METHOD FOR CONTROLLING ENGINE EXHAUST BACK PRESSURE

(75) Inventors: Timothy J. Johnson, Clinton Township, MI (US); Kevin C. Wong, Ann Arbor, MI (US); Mark D. Finkel, Clinton Township, MI (US); Steven M. Hubble, Ann Arbor, MI (US); Roger Bennett, New Baltimore, MI (US); Richard W. Gushman, Rochester Hills, MI (US); Kim Bloxsom, New Baltimore, MI (US); Joshua J. Ksiazkiewicz, Gilbert, AZ (US)

(73) Assignee: GM Global Technology Operations LLC

( * ) Notice: Subject to any disclaimer, the term of this patent is extended or adjusted under 35 U.S.C. 154(b) by 428 days.

(21) Appl. No.: 12/775,989

(22) Filed: May 7, 2010

(65) Prior Publication Data

US 2011/0276248 A1 Nov. 10, 2011

(51) Int. Cl.
*F02D 9/06* (2006.01)
*F02D 9/08* (2006.01)

(52) U.S. Cl. ..... 701/102; 123/323

(58) Field of Classification Search ..... 701/102, 701/101, 114; 123/323, 337, 568.11; 73/114.69, 73/114.71, 116.01, 116.04, 116.05
See application file for complete search history.

(56) References Cited

U.S. PATENT DOCUMENTS

| | | | | |
|---|---|---|---|---|
| 3,870,083 | A * | 3/1975 | Nezat | 138/45 |
| 4,404,946 | A * | 9/1983 | Hoard et al. | 123/486 |
| 2003/0029165 | A1 * | 2/2003 | Nakatani et al. | 60/288 |
| 2010/0005782 | A1 * | 1/2010 | Foster et al. | 60/277 |
| 2011/0036331 | A1 * | 2/2011 | Pocha | 123/559.1 |

* cited by examiner

*Primary Examiner* — Mahmoud Gimie

(57) ABSTRACT

A control system for an engine includes a restriction determination module and a valve control module. The restriction determination module determines a desired exhaust back pressure of the engine based on an exhaust flow rate of the engine. The valve control module selectively adjusts a valve position of an exhaust valve that restricts an exhaust flow of the engine based on the desired exhaust back pressure. The exhaust valve may include a valve body, a throttle plate, and an annular protrusion coupled to an inner surface of the valve body and protruding towards the throttle plate. The annular protrusion may abut a side of the throttle plate and may restrict fluid flow through an annular space between the throttle plate and the inner surface when the throttle plate is positioned in a rotational position transverse to a direction of fluid flow. A related method is also provided.

18 Claims, 5 Drawing Sheets

CONTROL SYSTEM AND METHOD FOR CONTROLLING ENGINE EXHAUST BACK PRESSURE

FIELD

The present disclosure relates to control systems and methods for internal combustion engines, and more particularly to control of engine exhaust back pressure during engine tests performed using engine test stands.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines may be tested on an engine test stand for a variety of purposes. For example, the engines may be tested during a research and development phase for the purposes of achieving a desired engine fuel efficiency, driveability, durability, and exhaust emissions. Engines may be tested at the end of an engine production line for the purpose of validating performance characteristics of the engine and ensuring engine quality. Engines already in service may be tested for the purpose of tuning one or more performance characteristics, such as engine torque output.

During testing, engine operating parameters may be set to achieve a desired engine operating state and engine variables and performance characteristics may be measured. The engine operating parameters may include a requested engine speed, a requested engine torque, and engine load. The engine variables and performance characteristics may include intake air flow, fuel flow, air-fuel ratios, exhaust emissions, and engine torque output.

SUMMARY

In one form, the present disclosure provides a control system for an engine that includes a restriction determination module and a valve control module. The restriction determination module determines a desired exhaust back pressure of the engine based on an exhaust flow rate of the engine. The valve control module selectively adjusts a valve position of an exhaust valve that restricts an exhaust flow of the engine based on the desired exhaust back pressure.

In one feature, the exhaust flow rate may be determined based on an intake air flow rate of the engine and a fuel flow rate of the engine. In another feature, the desired exhaust back pressure may correspond to an estimated exhaust back pressure at the exhaust flow rate generated by components of an exhaust system of the engine. In yet another feature, the desired exhaust back pressure may be one of retrieved from a table of back pressure values stored in memory based on the exhaust flow rate, and determined from a regression equation based on the exhaust flow rate. In still other features, the valve control module may further selectively adjust the valve position based on a measured exhaust back pressure of the engine.

In further features, the exhaust valve may be electromechanically-actuated and the valve control module may supply power to the exhaust valve based on the desired exhaust back pressure. In related features, the valve control module may monitor current supplied to the exhaust valve and discontinue power to the exhaust valve when the current exceeds a predetermined current. In other related features, the valve control module may further supply power to the exhaust valve based on a measured exhaust back pressure of the engine.

In still further features, the valve position may be a rotational valve position and the valve control module may adjust the rotational valve position towards a closed position in only one rotational direction. In yet other features, the valve control module may adjust the valve position to a closed position when the exhaust flow rate is less than a predetermined exhaust flow rate.

In yet further features, the exhaust valve may include a valve body, a throttle plate, and a first annular protrusion. The valve body may include an inner surface defining a fluid passage providing for fluid flow in a first direction. The throttle plate may be disposed within the fluid passage and may be supported for rotation between a first rotational position in which the throttle plate extends in the first direction and a second rotational position in which the throttle plate extends transverse to the first direction. A circumferential portion of the throttle plate may be separated from the inner surface by an annular space when the throttle plate is positioned in the second rotational position. The first annular protrusion may be coupled to the inner surface and may protrude towards the throttle plate. The first annular protrusion may abut a first side of the circumferential portion and may restrict fluid flow through the annular space when the throttle plate is positioned in the second rotational position.

In related features, the exhaust valve may further include a second annular protrusion coupled to the inner surface and protruding towards the throttle plate. The second annular protrusion may abut a second side of the circumferential portion opposite the first side and may further restrict fluid flow through the annular space when the throttle plate is positioned in the second rotational position.

In another form, the present disclosure provides a method for controlling an engine that includes determining a desired exhaust back pressure of the engine based on an exhaust flow rate of the engine, and selectively adjusting a valve position of an exhaust valve that restricts an exhaust flow of the engine based on the desired exhaust back pressure. In one feature, the exhaust flow rate may be determined based on an intake air flow rate of the engine and a fuel flow rate of the engine. In another feature, the desired exhaust back pressure may correspond to an estimated exhaust back pressure at the exhaust flow rate generated by components of an exhaust system of the engine. In yet another feature, the determining a desired exhaust back pressure may include one of retrieving the desired exhaust back pressure from a table of back pressure values stored in memory based on the exhaust flow rate, and determining the desired exhaust back pressure from a regression equation based on the exhaust flow rate. In still other features, the selectively adjusting the valve position may further include selectively adjusting the valve position based on a measured exhaust back pressure of the engine.

In further features, the exhaust valve may be electromechanically-actuated and the selectively adjusting the valve position may further include selectively supplying power to the exhaust valve based on the desired exhaust back pressure. In related features, the selectively supplying power may include monitoring current supplied to the exhaust valve and discontinuing power to the exhaust valve when the current exceeds a predetermined current. In other related features, the selectively supplying power to the exhaust valve may further include supplying power to the exhaust valve based on a measured exhaust back pressure of the engine.

In still further features, the valve position may be a rotational valve position and the selectively adjusting the valve position may include adjusting the rotational valve position towards a closed position in only one rotational direction. In yet other features, the selectively adjusting the valve position may include adjusting the valve position to a closed position when the exhaust flow rate is less than a predetermined exhaust flow rate.

In still other features, the systems and methods described above are implemented by a computer program executed by one or more processors. The computer program can reside on a tangible computer readable medium such as but not limited to memory, nonvolatile data storage, and/or other suitable tangible storage mediums.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
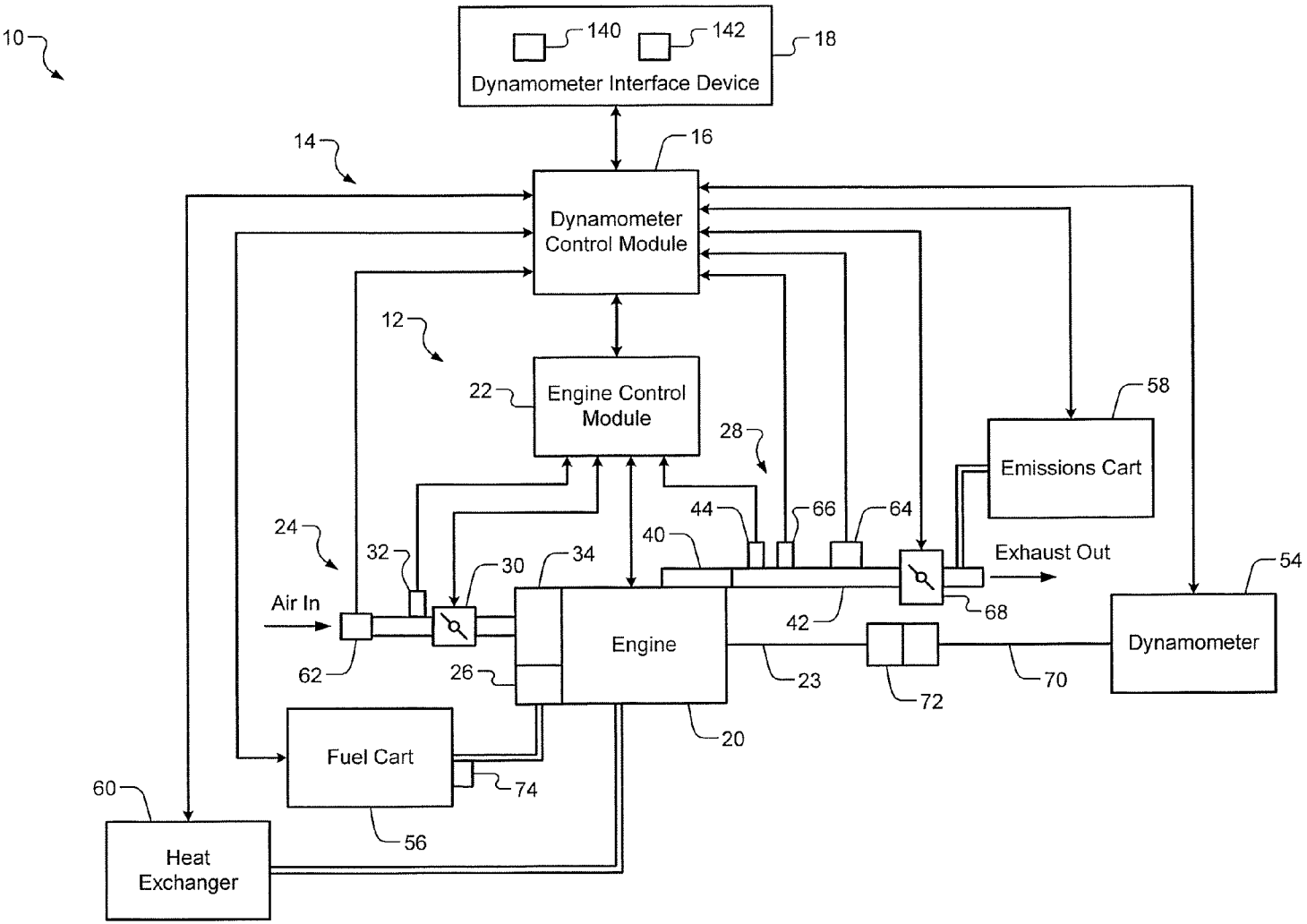
FIG. 1 is a functional block diagram illustrating an exemplary engine test facility according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

The present disclosure provides an exemplary control system and related method for closed-loop control of exhaust back pressure of an engine. The control system and method may be used, for example, during testing of the engine on an engine test stand. The control system includes a control module that controls an electromechanically-actuated exhaust valve that restricts exhaust flow through an exhaust system installed on the engine. The control module determines a desired exhaust back pressure based on an estimated mass flow rate of the exhaust produced by the engine. The control module controls exhaust back pressure by selectively adjusting a rotational position of the exhaust valve via an electrical motor that actuates the exhaust valve. The control module adjusts the rotational position based on the desired exhaust back pressure and a measured exhaust back pressure.

The exhaust valve includes a butterfly valve disposed within a valve body. The valve body includes annular valve stops that protrude inward from an inner surface of the valve body and abut a circumferential portion of the butterfly valve when the butterfly valve is in a closed position. The valve stops restrict exhaust flow past the butterfly valve in the space between the circumferential portion of the butterfly valve and the inner surface. By further restricting the exhaust flow in the space between the butterfly valve and the inner surface, the valve stops permit additional back pressure to be generated at low exhaust flow rates than may otherwise be possible without the valve stops.

The related method includes determining the desired exhaust back pressure based on the estimated mass flow rate of the exhaust. The method further includes selectively adjusting the position of the exhaust valve based on the desired exhaust back pressure and the measured exhaust back pressure.

The control system and related method of the present disclosure reduces engine testing time and improves the quality of the test results. Reduced testing time and improved quality are realized by reducing the time to make back pressure adjustments and providing improved accuracy in achieving the desired back pressure over a broader range of exhaust flow rates. The control system and related method of the present disclosure also reduces the cost of testing through reduced testing time and by eliminating the need to include catalytic converters, mufflers, and other restrictive exhaust components with an exhaust system used during testing. The control system and related method enable the use of a simplified exhaust system during testing that is easier to package within the footprint of the engine test stand. The simplified exhaust system may not include one or more restrictive components of a complete exhaust system of the engine to be tested.

With particular reference to FIG. 1, an exemplary engine test facility 10 according to the present disclosure may include an engine system 12 installed in an engine test stand 14 controlled by a dynamometer control module 16. The engine test facility 10 may be operated by an operator via a dynamometer interface device 18. Generally, the engine test facility 10 may be used to test internal combustion engine systems of any type. For example, the engine system 12 may include a reciprocating-type internal combustion engine 20 controlled by an engine control module (ECM) 22.

The engine 20 may combust a mixture of air and fuel in one or more cylinders (not shown) and thereby produce drive torque that is transmitted by a crankshaft 23. The engine 20 may include an air induction system 24, a fuel system 26, and an exhaust system 28. The air induction system 24 may direct air entering the engine 20 into the cylinders and may include a throttle 30, a mass air flow (MAF) sensor 32, and an intake manifold 34. The throttle 30 may regulate the amount of intake air entering the engine 20 and may be controlled by the ECM 22. The MAF sensor 32 may sense a mass flow rate of the air entering the engine 20. The fuel system 26 may meter fuel supplied to the engine 20 and may include one or more fuel injectors (not shown) that supply the fuel to the engine 20. The air induction system 24 and the fuel system 26 may be functionally representative of the corresponding systems of the engine system to be tested.

The exhaust system 28 may receive exhaust produced by the engine 20 and may be a simplified exhaust system operable to generate exhaust back pressure at various exhaust flow rates representative of the exhaust back pressure generated by a complete exhaust system of the engine system to be tested. For example, the exhaust system 28 may not include one or more restrictive components of the complete exhaust system, such as a catalytic converter, a muffler, and various exhaust piping. In various configurations, the exhaust system 28 may include one or more of the restrictive components in order to generate representative exhaust flow characteristics.

With continued reference to FIG. 1, the exhaust system 28 may include an exhaust manifold 40, a downpipe 42, and an oxygen sensor 44. The exhaust manifold 40 may receive exhaust exiting the engine 20 and may direct the exhaust into the downpipe 42. The oxygen sensor 44 may sense a concentration of oxygen in the exhaust and may be located within the downpipe 42. The exhaust manifold 40, the downpipe 42, and the oxygen sensor 44 may be functionally representative of the corresponding components of the complete exhaust system of the engine system to be tested.

The ECM 22 may control operation the engine 20, including engine speed and engine torque output. The ECM 22 may be representative of the corresponding control module or modules of the engine system to be tested. The ECM 22 may communicate with one or more modules of the engine test stand 14, such as the dynamometer control module 16, and may control operation of the engine 20 based on signals received from the dynamometer control module 16. For example, the ECM 22 may control the speed of the engine based on a requested engine speed communicated by the dynamometer control module 16. The ECM 22 may communicate one or more operating conditions of the engine 20 to the dynamometer control module 16.

Generally, the engine test stand 14 may have a conventional configuration and may include a dynamometer 54, a fuel cart 56, an emissions cart 58, and a heat exchanger 60. The engine test stand 14 may further include a MAF sensor 62, a pressure sensor 64, an air-fuel ratio (AFR) sensing device 66, and an exhaust valve assembly 68. The dynamometer control module 16 may communicate with the dynamometer interface device 18 and the various components of the engine test stand 14. The dynamometer control module 16 may control operation of the various components of the engine test stand 14 based on signals received from the dynamometer interface device 18 and the various components.

The dynamometer 54 may be of a conventional type operable to generate a torsional load on the engine 20 and may include a drive shaft 70 coupled to the crankshaft 23 via a coupler 72. The dynamometer 54 may further include various sensors for sensing torque transmitted to the drive shaft 70 by the crankshaft 23 and a rotational speed of the dynamometer 54.

The fuel cart 56 may contain a quantity of fuel and may supply the fuel under pressure to the fuel system 26 of the engine 20. The fuel cart 56 may be fluidly coupled to the fuel system 26 and may include a fuel flow meter device 74 that measures a mass flow rate of the fuel supplied to the fuel system 26. The fuel flow meter device 74 may generate a signal indicative of the measured mass flow rate.

The emissions cart 58 may be of a conventional type operable to measure concentrations of various constituents in the exhaust produced by the engine 20. The emissions cart 58 may communicate the concentrations measured to the dynamometer control module 16. The emissions cart 58 may be fluidly coupled to the exhaust system 28.

The heat exchanger 60 may be of a conventional type used in engine test stands operable to expel heat generated by the engine 20 during operation. The heat exchanger 60 may be fluidly coupled to a cooling system (not shown) of the engine 20.

The MAF sensor 62 may be a component of the engine test stand 14 that, similar to the MAF sensor 32, senses the mass flow rate of the air entering the engine 20. The MAF sensor 62 may generate a signal indicative of the mass flow rate sensed. The MAF sensor 62 may be a laminar flow element located at an inlet of the air induction system 24.

The pressure sensor 64 may be a component of the engine test stand 14 that senses a pressure of the exhaust within the exhaust system 28 and may generate a signal indicative of the pressure sensed. The pressure sensor 64 may be located upstream of the exhaust valve assembly 68 and thereby sense the back pressure in the exhaust generated by the exhaust valve assembly 68.

The AFR sensing device 66 may be a component of the engine test stand 14 that senses the air-fuel ratio from the exhaust in the exhaust system 28 and may generate a signal indicative of the air-fuel ratio sensed. The AFR sensing device 66 may be a wide-band oxygen sensor located within the exhaust system 28. The AFR sensing device 66 may be located within the downpipe 42 in close proximity to the oxygen sensor 44.

The exhaust valve assembly 68 may selectively restrict the flow of exhaust through the exhaust system 28 and thereby regulate back pressure within the exhaust system 28. While a single exhaust valve assembly 68 is shown, two or more exhaust valve assemblies may be provided. More than one exhaust valve assembly 68 may be provided in order to independently regulate the back pressure within separate flow paths of the exhaust. For example, in a V-type engine having two banks of cylinders, an exhaust valve assembly 68 may be provided for each bank to regulate the back pressure of the exhaust exiting each bank.

The exhaust valve assembly 68 may be located at or near an outlet of the exhaust system 28. With additional reference to FIGS. 2-3, the exhaust valve assembly 68 may be an electromechanically-actuated valve assembly that includes a valve 80 actuated by an electric motor 82 via a gear train 84. The valve 80 may be a throttle valve and may include a valve body 86, a throttle plate 88, and a pair of annular valve stops 90. The valve body 86 may include an inner surface 92 defining a fluid passage 94 providing fluid flow in a first direction indicated by arrow A (FIG. 3).

The throttle plate 88 may be disposed within the fluid passage 94 and may be rotated by a shaft 96 supported by the valve body 86. The throttle plate 88 may be rotated between a first rotational position corresponding to a fully open position and a second rotational position corresponding to a fully closed position. In the first rotational position, the throttle plate 88 may extend in the first direction of fluid flow. In FIG. 3, the first rotational position of the throttle plate 88 is shown in phantom. In the second rotational position, the throttle plate 88 may extend transverse to the first direction of fluid flow. As one example, the throttle plate 88 may extend normal to the first direction of fluid flow when positioned in the second rotational position. When in the second rotational position, a circumferential portion 98 of the throttle plate 88 may be separated from the inner surface 92 by an annular space 100 provided for clearance.

The valve stops 90 may be coupled to the inner surface 92 and may protrude from the inner surface 92 towards the throttle plate 88. The valve stops 90 may be coupled to the inner surface 92 in any desired manner, and may be formed integral with the valve body 86. The valve stops 90 may abut opposite sides of the circumferential portion 98 of the throttle plate 88 when the throttle plate 88 is rotationally positioned in the fully closed position. The valve stops 90 may generally have an arcuate shape (FIG. 2) complementary to the circumferential portion 98 of the throttle plate 88. The valve stops 90 may restrict the flow of exhaust past the throttle plate 88 through the annular space 100 when the throttle plate 88 is rotationally positioned in or near the fully closed position. By restricting the flow of exhaust through the annular space 100, the valve stops 90 may provide the exhaust valve assembly 68 with improved control of exhaust back pressure at low exhaust flow rates. While a pair of valve stops 90 is illustrated, it is understood that the present disclosure is not limited to such an arrangement. For example, the valve 80 may include a single valve stop similar to one of the valve stops 90.

A target wheel 102 may be fixed to the shaft 96 and may trigger a sensor 104, such as a proximity switch, when the throttle plate 88 is rotationally positioned in the fully open position.

The motor 82 may be of any type suitable for supplying torque for rotating the throttle plate 88 between the fully open and fully closed positions. For example, the motor 82 may be a direct current (DC) motor. The motor 82 may include a current sensing module 108 that senses a current supplied to the motor 82 and generates a signal indicative of the current sensed. The current sensing module 108 may include a current sensing device (not shown), such as an ammeter or an ammeter shunt, for sensing the current supplied.

The dynamometer control module 16 may control operation of the various components of the engine test stand 14 based on signals received from the dynamometer interface device 18. The dynamometer control module 16 may further control one or more operating parameters of the engine 20 via the ECM 22 based on the signals received. As discussed in further detail below, the dynamometer control module 16 may control operation of the exhaust valve assembly 68 and may thereby control the back pressure within the exhaust system 28.

Figure 2:
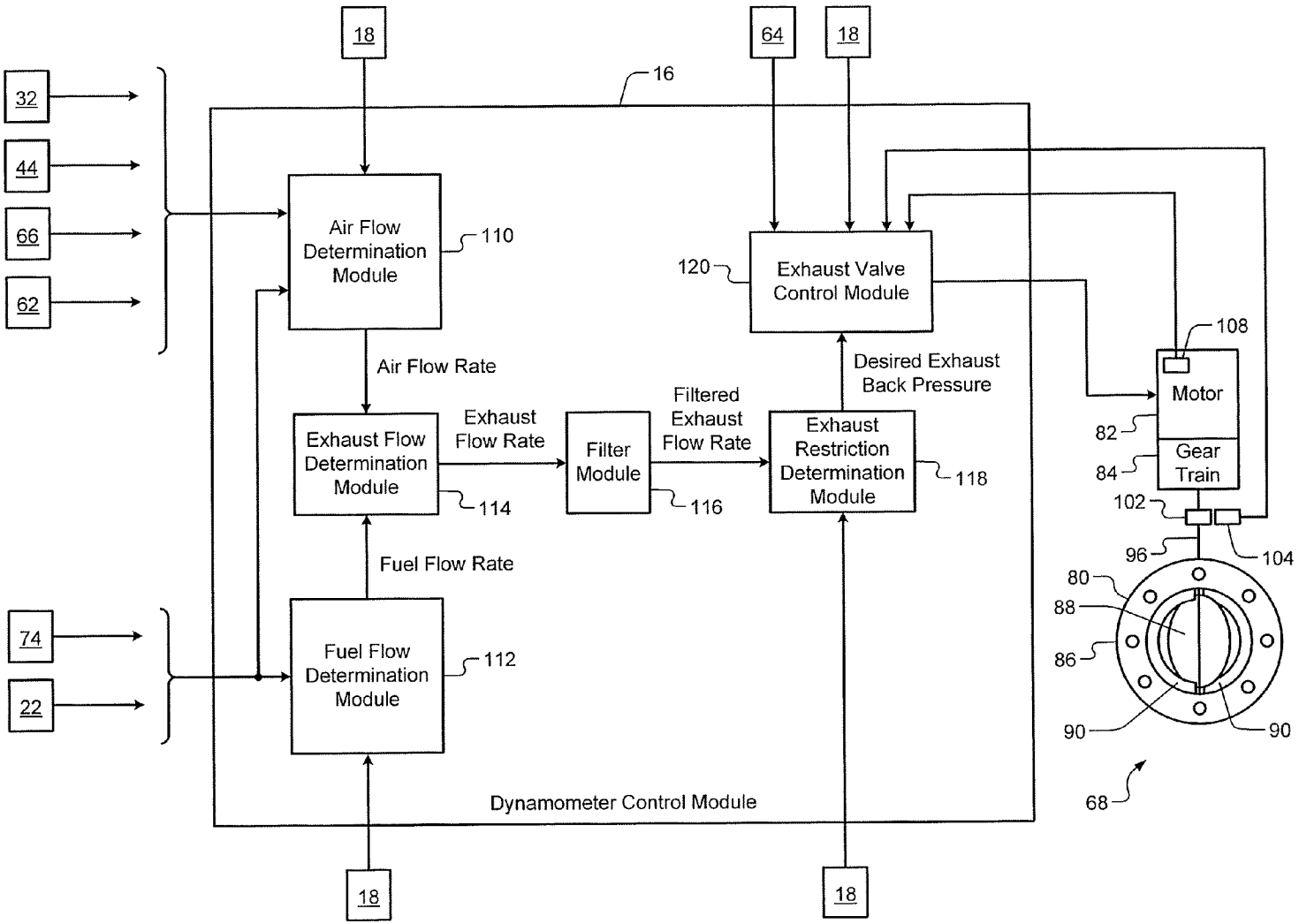
FIG. 2 is a functional block diagram illustrating an exemplary embodiment of the dynamometer control module shown in FIG. 1 in an exemplary control system according to the principles of the present disclosure.
Figure 3:
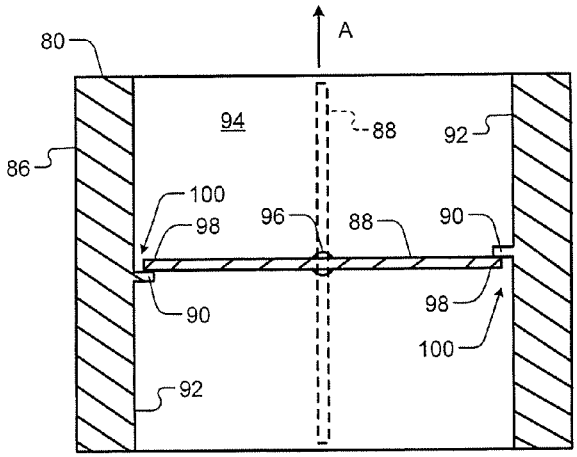
FIG. 3 is a partial cross-sectional view illustrating a portion of the valve body of the exhaust valve assembly shown in FIG. 2.

With particular reference to FIG. 2, an exemplary implementation of the dynamometer control module 16 in an exemplary control system according to the present disclosure is shown. The dynamometer control module 16 includes an air flow determination module 110, a fuel flow determination module 112, and an exhaust flow determination module 114. The dynamometer control module 16 further includes a filter module 116, an exhaust restriction determination module 118, and an exhaust valve control module 120.

The air flow determination module 110 may periodically determine a mass flow rate of the intake air entering the engine 20 ($MAFRate_{ENGINE}$) based on one or more signals generated by the engine system 12 and/or the engine test stand 14. The air flow determination module 110 may output a signal indicative of the current mass flow rate of intake air, $MAFRate_{ENGINE}$, determined. The mass flow rate of the intake air may be determined based on the signal generated by the MAF sensor 62 of the engine test stand 14 and/or the signal generated by the MAF sensor 32 of the engine system 12.

Alternately or additionally, the mass flow rate of the intake air may be determined based on the signal generated by the fuel flow meter device 74 of the fuel cart 56 and one of the signal generated by the AFR sensing device 66 and the signal generated by the oxygen sensor 44 of the engine system 12. For example, the mass flow rate of the intake air may be determined based on a product of the fuel flow rate and the air-fuel ratio indicated by the fuel flow meter device 74 and the AFR sensing device 66, respectively.

When determining $MAFRate_{ENGINE}$, the air flow determination module 110 may directly receive the signals generated by the various components (e.g., sensors) of the engine system 12 and the engine test stand 14. Alternately or additionally, the air flow determination module 110 may receive information communicated by the ECM 22 based on the signals generated by the components of the engine system 12. For example, the ECM 22 may communicate an estimated mass flow rate of the intake air based on the signal generated by the MAF sensor 32 of the engine system 12. The particular signal or signals used by the air flow determination module 110 when determining $MAFRate_{ENGINE}$ may be selected by the operator via the dynamometer interface device 18.

The fuel flow determination module 112 may periodically determine a mass flow rate ($FUELRate_{ENGINE}$) of the fuel supplied to the engine 20 based on one or more signals generated by the engine system 12 and/or the engine test stand 14. The fuel flow determination module 112 may output a signal indicative of the current mass flow rate of the fuel supplied, $FUELRate_{ENGINE}$, determined. The mass flow rate of the fuel supplied may be determined based on the signal generated by the fuel flow meter device 74 of the fuel cart 56 and/or control signals generated by the ECM 22 for controlling the fuel supplied by the fuel system 26.

When determining $FUELRate_{ENGINE}$, the fuel flow determination module 112 may directly receive the signals generated by the various sensors and components of the engine system 12 and/or the engine test stand 14. Alternately or additionally, the fuel flow determination module 112 may receive information communicated by the ECM 22 based on various signals generated by the components of the engine system 12. For example, the ECM 22 may communicate an estimated mass flow rate of the fuel supplied by the fuel system 26. The particular signals and/or information used by the fuel flow determination module 112 when determining $FUELRate_{ENGINE}$ may be selected by the operator via the dynamometer interface device 18.

The exhaust flow determination module 114 may periodically determine an estimated mass flow rate of the exhaust ($EXHAUSTRate_{ENGINE}$) produced by the engine 20 based on $MAFRate_{ENGINE}$ and $FUELRate_{ENGINE}$. The exhaust flow determination module 114 may output a signal indicative of the current mass flow rate of the exhaust, $EXHAUSTRate_{ENGINE}$, determined. The mass flow rate of the exhaust may be calculated by summing the mass flow rates of the intake air and fuel (e.g., $EXHAUSTRate_{ENGINE}$=$MAFRate_{ENGINE}$ $FUELRate_{ENGINE}$).

The filter module 116 may receive the signal generated by the exhaust flow determination module 114 and may filter the signal received and thereby generate a filtered signal indicative of a current filtered mass flow rate of the exhaust (Filtered $EXHAUSTRate_{ENGINE}$). The filter module 116 may filter the signal generated by the exhaust flow determination module to reduce unwanted effects of noise that may be present in the signals used to determine the mass flow rate of the exhaust. The filter module 116 may include one or more conventional filters of various types, including a first-order lag filter.

The exhaust restriction determination module 118 may periodically determine a desired exhaust back pressure (Desired $BACKPRESSURE_{EXHAUST}$) based on the filtered mass flow rate of the exhaust, Filtered $EXHAUSTRate_{ENGINE}$, indicated by the signal generated by the filter module 116. The exhaust restriction determination module 118 may output a signal indicative of the current desired exhaust back pressure, Desired $BACKPRESSURE_{EXHAUST}$, determined.

In the present example, the desired exhaust back pressure may be equal to an estimated exhaust back pressure that would be generated by the complete exhaust system of the engine system to be tested at an exhaust mass flow rate equal to Filtered $EXHAUSTRate_{ENGINE}$.

The exhaust restriction determination module 118 may determine the desired exhaust back pressure according to one of several methods. The particular method used by the exhaust restriction determination module 118 may be selected or input by the operator via the dynamometer interface device 18. As one example, the desired exhaust back pressure may be looked up in a memory table stored in memory (not shown) of the dynamometer control module 16 based on the filtered mass flow rate of the exhaust, Filtered $EXHAUSTRate_{ENGINE}$. Values for the desired exhaust back pressure stored in the memory table may be predetermined values obtained from empirical testing and/or computational analysis of the complete exhaust system of the engine system to be tested.

As another example, the desired exhaust back pressure may be determined using a regression equation obtained from empirical testing and/or computational analysis of the complete exhaust system of the engine system to be tested. The regression equation may express the desired exhaust back pressure as a function of exhaust mass flow rate and may be any mathematical function or calculation expressing the desired exhaust back pressure for a given exhaust mass flow rate input. For example, the regression equation may be a polynomial function represented by the following equation: $f(x)=a_N x^N+a_{N-1}x^{N-1}+\ldots+a_2x^2+a_1x+a_0$, where f(x) represents the desired exhaust back pressure, x represents the exhaust mass flow rate, N is a predetermined non-negative integer, and $a_0$, $a_1$, $a_2$, . . . , $a_{N-1}$, and $a_N$ are predetermined constant coefficients. The coefficients and integer N may be predetermined based on empirical testing and/or computational analysis of the complete exhaust system of the engine system to be tested.

The exhaust valve control module 120 may control operation of the exhaust valve assembly 68 based on the desired exhaust back pressure, Desired $BACKPRESSURE_{EXHAUST}$. More specifically, the exhaust valve control module 120 may control the rotational position of the throttle plate 88 based on the desired exhaust back pressure. As discussed in further detail below, the exhaust valve control module 120 may further control the rotational position of the throttle plate 88 based on the signal generated by the pressure sensor 64 in response to the pressure sensed within the exhaust system 28.

Figure 4:
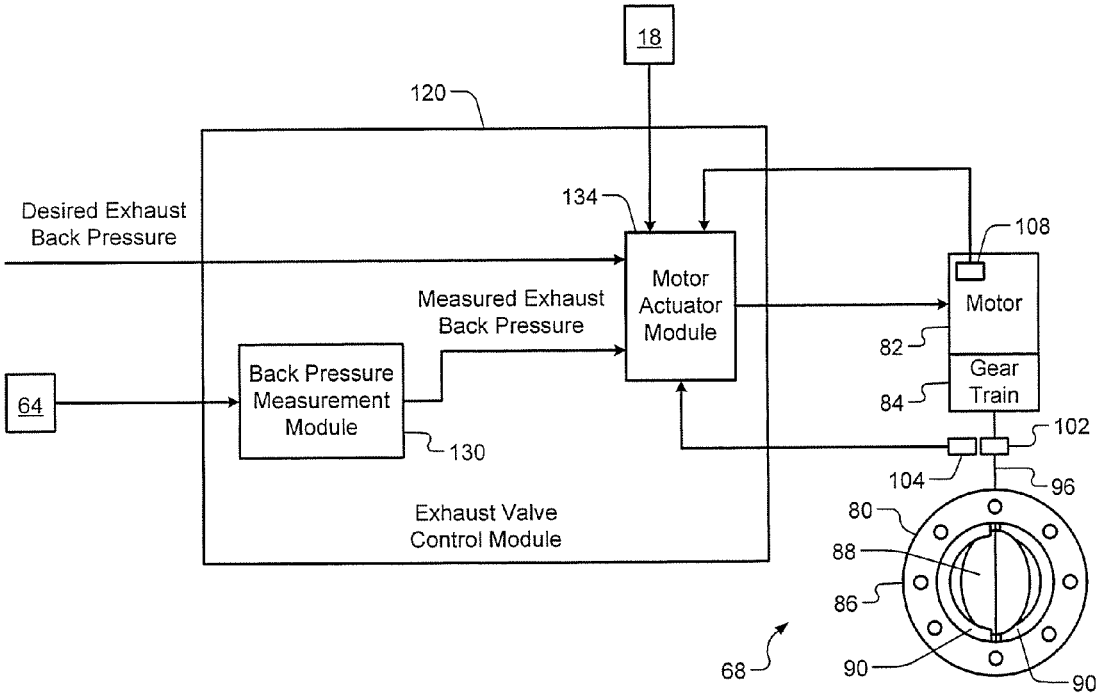
FIG. 4 is a functional block diagram illustrating an exemplary embodiment of the exhaust valve control module shown in FIG. 2 according to the principles of the present disclosure.

With particular reference to FIG. 4, an exemplary implementation of the exhaust valve control module 120 may include a back pressure measurement module 130 and a motor actuator module 134. The back pressure measurement module 130 may periodically determine a measured exhaust back pressure (Measured $BACKPRESSURE_{EXHAUST}$) based on the signal generated by the pressure sensor 64. The back pressure measurement module 130 may output a signal indicative of the current measured exhaust back pressure, Measured $BACKPRESSURE_{EXHAUST}$, determined.

The motor actuator module 134 may selectively adjust the rotational position of the throttle plate 88 based on the desired exhaust back pressure, Desired $BACKPRESSURE_{EXHAUST}$, and the measured exhaust back pressure, Measured $BACKPRESSURE_{EXHAUST}$. In general, the motor actuator module 134 may adjust the rotational position of the throttle plate 88 so that the measured exhaust back pressure is maintained at or near the desired exhaust back pressure.

The motor actuator module 134 may rotate the throttle plate 88 towards the fully closed position when the measured exhaust back pressure, Measured $BACKPRESSURE_{EXHAUST}$, is less than the desired back pressure, Desired $BACKPRESSURE_{EXHAUST}$. The motor actuator module 134 may also rotate the throttle plate 88 towards the fully closed position when the filtered mass flow rate of the exhaust, Filtered $EXHAUSTRate_{ENGINE}$, is less than a predetermined exhaust flow rate. The motor actuator module 134 may maintain the throttle plate 88 in the fully closed position while the filtered mass flow rate of the exhaust is less than the predetermined exhaust flow rate. The motor actuator module 134 may rotate the throttle plate 88 towards the fully open position when the measured exhaust back pressure, Measured $BACKPRESSURE_{EXHAUST}$, is greater than the desired back pressure, Desired $BACKPRESSURE_{EXHAUST}$.

The motor actuator module 134 may adjust the rotational position of the throttle plate 88 by supplying power to the motor 82 for rotating the throttle plate 88 towards one of the fully closed position and the fully open position. Once the throttle plate 88 is in the desired rotational position, the motor actuator module 134 may discontinue power to the motor 82 to maintain the desired rotational position. The motor actuator module 134 may include a control loop feedback mechanism (e.g., control loop feedback module) that controls the amount of power supplied to the motor 82 and thereby controls a difference between the desired and measured exhaust back pressures. The control loop feedback mechanism may include various types of closed-loop control mechanisms. As one example, the control loop feedback mechanism may include a proportional-integral-derivative (PID) control mechanism. Parameters, such as proportional, integral, and derivative control values, may be predetermined for the particular engine system 12 being tested. Alternately or additionally, the parameters may be input and/or adjusted by the operator via the dynamometer interface device 18.

While supplying power for rotating the throttle plate 88 towards the fully open position, the motor actuator module 134 may halt the supply of power when the sensor 104 indicates the throttle plate 88 has reached the fully open position. While supplying power to rotate the throttle plate towards one of the fully closed position and the fully open position, the motor actuator module 134 may also halt the supply of power when the current supplied to the motor 82 exceeds a predetermined current. In this way, the motor actuator module 134 may prevent damage to the motor 82 and/or the gear train 84 when the throttle plate 88 has reached the fully closed position and is abutting the valve stops 90. The motor actuator module 134 may further halt the supply of power to maintain the throttle plate 88 in the fully closed position. The motor actuator module 134 may monitor the current supplied by monitoring the signal generated by the current sensing module 108 while supplying power.

Referring again to FIG. 1, the dynamometer interface device 18 may include a display 140 and one or more operator controls 142. The display 140 may convey (e.g., display) various information to the operator, including one or more operating conditions of the engine system 12 and/or the engine test stand 14. The operator controls 142 may include an input device (not shown) and one or more selector switches (not shown) that may enable the operator to provide inputs to the engine test stand 14.

Figure 6:
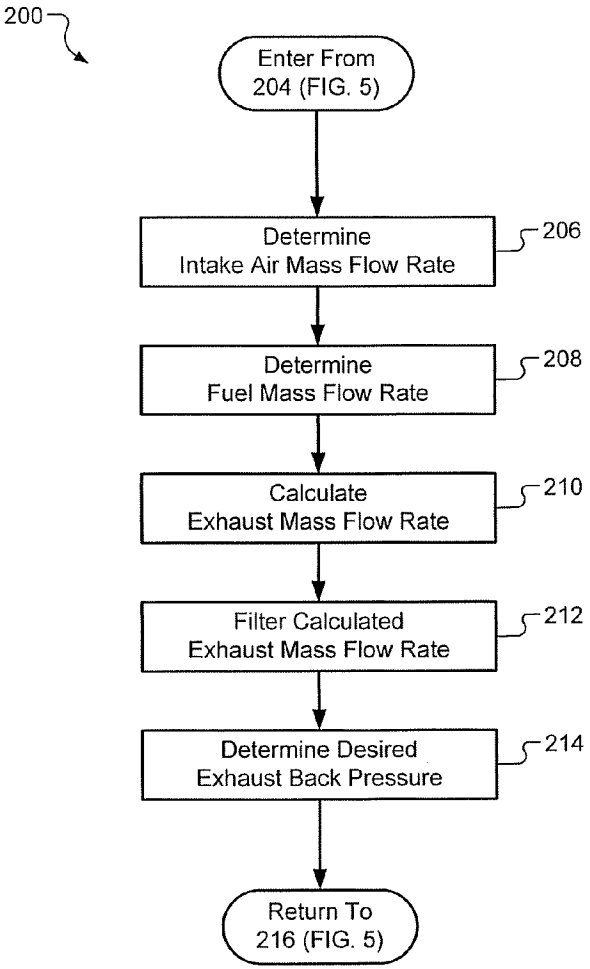
FIGS. 5-7 are flow diagrams illustrating an exemplary method for controlling engine exhaust back pressure according to the principles of the present disclosure.
Figure 5:
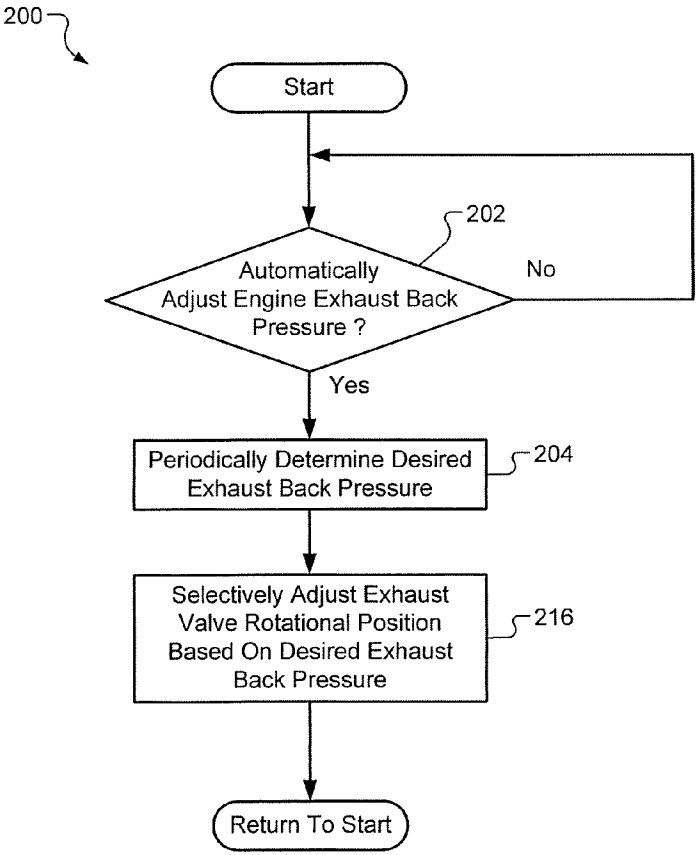
Figure 7:
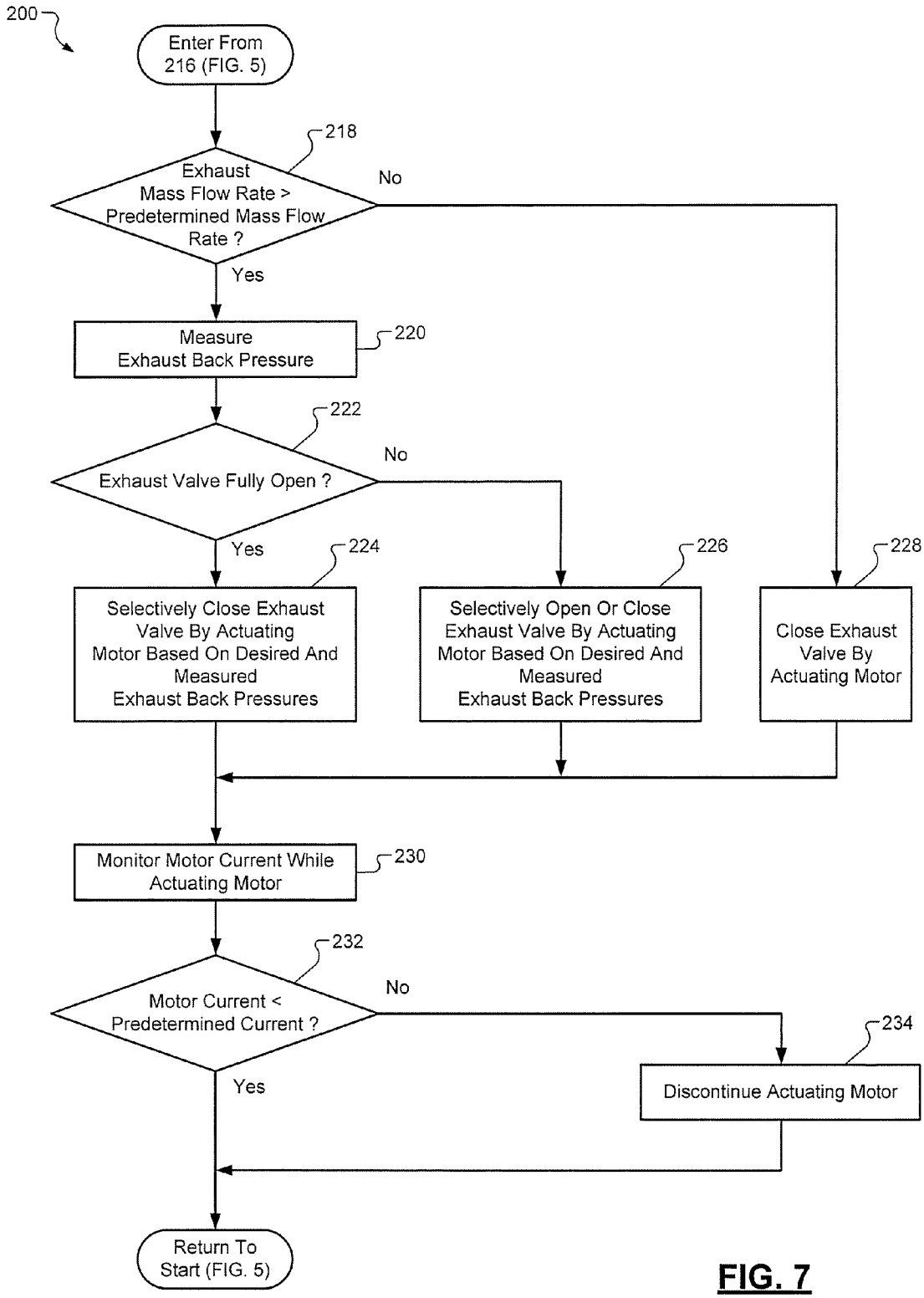

With reference to FIGS. 5-7, an exemplary method 200 for controlling exhaust back pressure of an engine using an electromechanically-actuated exhaust valve is shown. The method may be used during testing on an engine test stand. As discussed in further detail below, the method 200 may provide closed-loop control of the exhaust valve. The method 200 may be performed by various control modules to control the exhaust back pressure using the exhaust valve. For simplicity, the method 200 will be described with reference to the various components of the engine test facility 10 previously described. In this way, operation of the various components of the engine test facility 10 may also be more fully described.

With particular reference to FIG. 5, the method 200 begins at 202 where the dynamometer control module 16 may determine whether to automatically adjust engine exhaust back pressure. If yes, then control may proceed at 204, otherwise control may loop back as shown.

At 204, the dynamometer control module 16 may periodically determine the desired exhaust back pressure, Desired $BACKPRESSURE_{EXHAUST}$, for the engine 20. The desired exhaust back pressure may be determined at regular intervals by the dynamometer control module 16. With particular reference to FIG. 6, an exemplary method for determining the desired exhaust back pressure at 204 according to the present disclosure is shown.

At 206, the air flow determination module 110 may determine the mass flow rate of the intake air entering the engine 20, $MAFRate_{ENGINE}$, for the current control loop.

At 208, the fuel flow determination module 112 may determine the mass flow rate of the fuel supplied to the engine 20, $FUELRate_{ENGINE}$, for the current control loop.

At 210, the exhaust flow determination module 114 may determine the estimated mass flow rate of the exhaust produced by the engine 20 for the current control loop, $EXHAUSTRate_{ENGINE}$. The exhaust flow determination module 114 may determine the estimated mass flow rate of the exhaust based on the mass flow rates of the intake air and fuel, $MAFRate_{ENGINE}$ and $FUELRate_{ENGINE}$, determined at 206 and 208 of the current control loop. The estimated mass flow rate of exhaust may be determined based on a sum of the mass flow rates of the intake air and fuel.

At 212, the filter module 116 may determine the filtered mass flow rate of the exhaust, Filtered $EXHAUSTRate_{ENGINE}$, for the current control loop based on the value of $EXHAUSTRate_{ENGINE}$ determined at 210 in the current and prior control loops. The filter module 116 may determine the filtered mass flow rate of the exhaust for the current control loop to reduce unwanted effects of noise that may be present in one or more of the values of $EXHAUSTRate_{ENGINE}$, $MAFRate_{ENGINE}$, and $FUELRate_{ENGINE}$ determined at 206, 208, and 210.

At 214, the exhaust restriction determination module 118 may determine the desired exhaust back pressure, Desired $BACKPRESSURE_{EXHAUST}$, for the current control loop based on the Filtered $EXHAUSTRate_{ENGINE}$ determined at 212.

Referring again to FIG. 5, control may proceed at 216 from 214. At 216, the dynamometer control module 16 may selectively adjust the rotational position of the exhaust valve assembly 68 based on the desired exhaust back pressure, Desired $BACKPRESSURE_{EXHAUST}$, determined at 204. The dynamometer control module 16 may further adjust the rotational position based on the measured exhaust back pressure, Measured $BACKPRESSURE_{EXHAUST}$, the filtered mass flow rate of the exhaust, Filtered $EXHAUSTRate_{ENGINE}$, the current supplied to the exhaust valve assembly 68, and whether the exhaust valve assembly 68 is in the fully open position. From 216, control may return to the start to begin another control loop in the method 200.

With particular reference to FIG. 7, an exemplary method for selectively adjusting the rotational position of the exhaust valve assembly 68 at 216 according to the present disclosure is shown. At 218, the exhaust valve control module 120 may determine whether the filtered mass flow rate of the exhaust, Filtered $EXHAUSTRate_{ENGINE}$, for the current control loop is greater than the predetermined exhaust flow rate. If yes, then control may proceed at 220, otherwise control may proceed at 228 as shown.

At 220, the exhaust valve control module 120 may measure the back pressure of the exhaust and thereby determine the measured exhaust back pressure, Measured $BACKPRESSURE_{EXHAUST}$, for the current control loop.

Control may proceed at 222, where the exhaust valve control module 120 may determine whether the exhaust valve assembly 68, and more specifically the throttle plate 88 of the exhaust valve assembly, is rotationally positioned in the fully open position. If yes, then control may proceed at 224, otherwise control may proceed at 226.

At 224, the exhaust valve control module 120 may selectively adjust the rotational position of the exhaust valve assembly 68, and more specifically the throttle plate 88, towards the fully closed position. The exhaust valve control module 120 may rotate the throttle plate 88 towards the fully closed position when the measured exhaust back pressure, Measured $BACKPRESSURE_{EXHAUST}$, is less than the desired back pressure, Desired $BACKPRESSURE_{EXHAUST}$. The exhaust valve control module 120 may rotate the throttle plate 88 by supplying power to the motor 82 for rotating the throttle plate 88 towards the fully closed position.

At 226, the exhaust valve control module 120 may selectively adjust the rotational position of the exhaust valve assembly 68, and more specifically the throttle plate 88, towards one of the fully closed and the fully open positions. The exhaust valve control module 120 may rotate the throttle plate 88 towards the fully closed position when the measured exhaust back pressure, Measured $BACKPRESSURE_{EXHAUST}$, is less than the desired back pressure, Desired $BACKPRESSURE_{EXHAUST}$. The exhaust valve control module 120 may rotate the throttle plate 88 towards the fully open position when the measured exhaust back pressure, Measured $BACKPRESSURE_{EXHAUST}$, is greater than the desired back pressure, Desired $BACKPRESSURE_{EXHAUST}$. The exhaust valve control module 120 may rotate the throttle plate 88 by supplying power to the motor 82 for rotating the throttle plate 88 towards one of the fully closed position and the fully open position.

At 228, the exhaust valve control module 120 may rotate the exhaust valve assembly 68, and more specifically the throttle plate 88, towards the fully closed position. The exhaust valve control module 120 may continue to rotate the throttle plate 88 until the throttle plate 88 is rotationally positioned in the fully closed position.

At 230, the exhaust valve control module 120 may monitor the current supplied to the motor 82 while supplying power at one of 224, 226, and 228. At 232, the exhaust valve control module 120 may determine whether the current supplied to the motor 82 exceeds the predetermined current. If the current supplied to the motor 82 is less than the predetermined current, then control may return to start as shown (FIG. 5) to begin another control loop in the method 200, otherwise control may proceed at 234.

At 234, the exhaust valve control module 120 may discontinue supplying power to the motor 82 at one of 224, 226, and 228. The exhaust valve control module 120 may discontinue supplying power (i.e., discontinue actuating the motor 82) to inhibit further rotation of the throttle plate 88 towards the fully closed position and/or to maintain the throttle plate 88 in the fully closed position. Control may discontinue supplying power to avoid damage to one or more components of the exhaust valve assembly 68 while adjusting the rotational position of the throttle plate 88. Control may discontinue supplying power to maintain the throttle plate 88 in the fully closed position while the filtered mass flow rate of the exhaust, Filtered $EXHAUSTRate_{ENGINE}$, is less than the predetermined exhaust flow rate. From 234, control may return to start as shown (FIG. 5) to begin another control loop in the method 200.

From the foregoing, it will be appreciated that control may proceed according to 204-234 as discussed above while control (e.g., the dynamometer control module 16) determines to automatically adjust engine exhaust back pressure at 202. It will be further appreciated that control at 204-234 may proceed in a periodic manner and a period of control during each control loop may remain constant.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system for an engine comprising:

a restriction determination module that determines a desired exhaust back pressure of said engine based on an exhaust flow rate of said engine; and a valve control module that selectively adjusts a valve position of an exhaust valve that restricts an exhaust flow of said engine based on said desired exhaust back pressure, wherein said exhaust flow rate is determined based on an intake air flow rate of said engine and a fuel flow rate of said engine.

2. The control system of claim 1, wherein said desired exhaust back pressure corresponds to an estimated exhaust back pressure at said exhaust flow rate generated by components of an exhaust system of said engine.

3. The control system of claim 1, wherein said desired exhaust back pressure is one of retrieved from a table of back pressure values stored in memory based on said exhaust flow rate and determined from a regression equation based on said exhaust flow rate.

4. The control system of claim 1, wherein said valve control module further selectively adjusts said valve position based on a measured exhaust back pressure of said engine.

5. The control system of claim 1, wherein said exhaust valve is electromechanically-actuated and said valve control module supplies power to said exhaust valve based on said desired exhaust back pressure.

6. The control system of claim 5, wherein said valve control module monitors current supplied to said exhaust valve and discontinues power to said exhaust valve when said current exceeds a predetermined current.

7. The control system of claim 1, wherein said valve control module adjusts said valve position to a closed position when said exhaust flow rate is less than a predetermined exhaust flow rate.

8. A control system for an engine comprising:

a restriction determination module that determines a desired exhaust back pressure of said engine based on an exhaust flow rate of said engine; and a valve control module that selectively adjusts a valve position of an exhaust valve that restricts an exhaust flow of said engine based on said desired exhaust back pressure, wherein said exhaust valve includes:

a valve body including an inner surface defining a fluid passage providing for fluid flow in a first direction;

a throttle plate disposed within said fluid passage and supported for rotation between a first rotational position in which said throttle plate extends in said first direction and a second rotational position in which said throttle plate extends transverse to said first direction, a circumferential portion of said throttle plate separated from said inner surface by an annular space when said throttle plate is positioned in said second rotational position; and a first annular protrusion coupled to said inner surface and protruding towards said throttle plate, said first annular protrusion abutting a first side of said circumferential portion and restricting fluid flow through said annular space when said throttle plate is positioned in said second rotational position.

9. The control system of claim 8, wherein said exhaust valve further includes a second annular protrusion coupled to said inner surface and protruding towards said throttle plate, said second annular protrusion abutting a second side of said circumferential portion opposite said first side and further restricting fluid flow through said annular space when said throttle plate is positioned in said second rotational position.

10. A method for controlling an engine comprising:

determining a desired exhaust back pressure of said engine based on an exhaust flow rate of said engine; and selectively adjusting a valve position of an exhaust valve that restricts an exhaust flow of said engine based on said desired exhaust back pressure, wherein said exhaust flow rate is determined based on an intake air flow rate of said engine and a fuel flow rate of said engine.

11. The method of claim 10, wherein said desired exhaust back pressure corresponds to an estimated exhaust back pressure at said exhaust flow rate generated by components of an exhaust system of said engine.

12. The method of claim 10, wherein said determining a desired exhaust back pressure includes one of retrieving said desired exhaust back pressure from a table of back pressure values stored in memory based on said exhaust flow rate and determining said desired exhaust back pressure from a regression equation based on said exhaust flow rate.

13. The method of claim 10, wherein said selectively adjusting said valve position further includes selectively adjusting said valve position based on a measured exhaust back pressure of said engine.

14. The method of claim 10, wherein said exhaust valve is electromechanically-actuated, and wherein said selectively adjusting said valve position further includes selectively supplying power to said exhaust valve based on said desired exhaust back pressure.

15. The method of claim 14, wherein said selectively supplying power includes monitoring current supplied to said exhaust valve and discontinuing power to said exhaust valve when said current exceeds a predetermined current.

16. The method of claim 14, wherein said selectively supplying power to said exhaust valve further includes supplying power to said exhaust valve based on a measured exhaust back pressure of said engine.

17. The method of claim 14, wherein said valve position is a rotational valve position, and wherein said selectively adjusting said valve position includes adjusting said rotational valve position towards a closed position in only one rotational direction.

18. The method of claim 10, wherein said selectively adjusting said valve position includes adjusting said valve position to a closed position when said exhaust flow rate is less than a predetermined exhaust flow rate.

* * * * *